US009188917B2

(12) United States Patent
Yasuda

(10) Patent No.: US 9,188,917 B2
(45) Date of Patent: Nov. 17, 2015

(54) IMAGE FORMING APPARATUS INCLUDING FUSER UNIT FOR FIXING DEVELOPER IMAGE ON RECORDING MEDIUM

(75) Inventor: Masaki Yasuda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 816 days.

(21) Appl. No.: 13/358,936

(22) Filed: Jan. 26, 2012

(65) Prior Publication Data

US 2012/0189338 A1 Jul. 26, 2012

(30) Foreign Application Priority Data

Jan. 26, 2011 (JP) ..... 2011-013816

(51) Int. Cl.
*G03G 15/20* (2006.01)

(52) U.S. Cl.
CPC ..... *G03G 15/2046* (2013.01); *G03G 15/205* (2013.01); *G03G 15/2039* (2013.01); *G03G 15/2078* (2013.01)

(58) Field of Classification Search
CPC ..... G03G 15/2078; G03G 15/2046; G03G 15/205
USPC ..... 399/33, 69
See application file for complete search history.

(56) References Cited

U.S. PATENT DOCUMENTS

| | | | |
|---|---|---|---|
| 8,135,298 | B2 | 3/2012 | Ogiso et al. |
| 8,301,050 | B2 | 10/2012 | Funatsu |
| 2009/0110418 | A1 | 4/2009 | Ogiso et al. |
| 2009/0196644 | A1 | 8/2009 | Funatsu |
| 2010/0054785 | A1* | 3/2010 | Ogiso et al. ..... 399/69 |

FOREIGN PATENT DOCUMENTS

| | | | |
|---|---|---|---|
| JP | 02-197908 | | 8/1990 |
| JP | 06-301255 | A | 10/1994 |
| JP | 2002-296960 | A | 10/2002 |
| JP | 2005-234273 | A | 9/2005 |
| JP | 2006-018099 | A | 1/2006 |
| JP | 04-058274 | B2 | 3/2008 |
| JP | 04-181981 | B2 | 11/2008 |
| JP | 2009-063821 | A | 3/2009 |
| JP | 2009-109911 | A | 5/2009 |
| JP | 2009-181065 | A | 8/2009 |
| JP | 2010-181711 | A | 8/2010 |
| JP | 05-088572 | B2 | 12/2012 |

* cited by examiner

*Primary Examiner* — David Gray
*Assistant Examiner* — Andrew V Do
(74) *Attorney, Agent, or Firm* — Banner & Witcoff, Ltd.

(57) ABSTRACT

An image forming apparatus includes: a fuser unit, which includes a heating member heated by a heat source and a backup member; a temperature detector; and a control unit, which starts print control when a detected temperature reaches the fixing temperature while the temperature of the heating member is increasing to a fixing temperature, and which performs decreasing control when the detected temperature reaches a predetermined temperature higher than the fixing temperature. In a case that an increasing rate of the detected temperature at the beginning of the print control is equal to or less than a predetermined value, the control unit controls the heat source so that a heat quantity radiated from the heat source during the decreasing control becomes larger than that in the case that the increasing rate of the detected temperature at the beginning of the print control is larger than the predetermined value.

18 Claims, 9 Drawing Sheets

IMAGE FORMING APPARATUS INCLUDING FUSER UNIT FOR FIXING DEVELOPER IMAGE ON RECORDING MEDIUM

CROSS-REFERENCE TO RELATED APPLICATION

This application claims priority from Japanese Patent Application No. 2011-013816 filed on Jan. 26, 2011, the entire subject matter of which is incorporated herein by reference.

TECHNICAL FIELD

This disclosure relates to an image forming apparatus including a fuser unit for fixing a developer image on a recording sheet by heat.

BACK GROUND

It is known that an image forming apparatus which includes a fuser unit that has a heating member heated by a heat source and a backup member for nipping a recording sheet between the backup member and the heating member, and a control unit that controls the fuser unit. In this apparatus, generally, when the control unit receives a print command, the heat source is turned on to heat the heating member to a predetermined fixing temperature. Then, when the heating member reaches the fixing temperature, print control, in which supply of power to the heat source is controlled between on and off to maintain the heating member at the fixing temperature, is performed, for example.

SUMMARY

However, in case that the heating member has low heat capacity (such as a case where the heating member is a plate-shaped member), the heat quantity of the heating member is absorbed by sheets during the print control, so that the temperature of the heating member significantly decreases. This decreasing in the temperature of the heating member easily occurs when the temperature of the backup member, which is to be contact with the heating member, is low.

For this reason, as shown in FIGS. 9A and 9B for instance, in case that the temperature of the backup member or the like is low, the heat source, when a power supply is ON, may be switched from an OFF mode to an ON mode (at a time point t1). Then, when a print command is received (at a time point t2) while the temperature of the heating member is increasing, the heat source may be maintained at the ON mode until the temperature of the heating member reaches a predetermined temperature higher than the fixing temperature (from a time point t1 to a time point t4). When the temperature of the heating member reaches the predetermined temperature (at a time point t4), the heat source may be switched off so that the temperature of the heating member is decreased to the fixing temperature. According to this control, even after the temperature of the heating member reaches the fixing temperature so that the print control starts (at a time point t3), the heat source is maintained at the ON mode. Therefore, even if a sheet absorbs the heat of the heating member during the print control, it is possible to suppress the heat member from becoming the fixing temperature or less.

However, in the above-mentioned control, when the temperature of the heating member reaches the predetermined temperature (at the time point t4), the heat source is switched off so that the temperature of the heating member is decreased to the fixing temperature at once. Therefore, in case that the temperature of the backup member is significantly low, the gradient of the decreasing in the temperature of the heating member (after the time point t4) is rapid. As a result, the temperature of the heating member may be decreased below the fixing temperature, and a so-called undershoot problem may occur (from a time point t5 to a time point t6).

This disclosure provides an image forming apparatus capable of suppressing undershoot of a temperature of a heating member.

In view of the above, an image forming apparatus of this disclosure comprises: a fuser unit, which includes a heating member heated by a heat source and a backup member to nip a recording sheet between the backup member and the heating member; a temperature detector, which detects a temperature of the heating member; and a control unit, which starts print control when a temperature detected by the temperature detector reaches the fixing temperature when a print command is received while the temperature of the heating member is increasing to a fixing temperature, and which performs decreasing control when the detected temperature reaches a predetermined temperature higher than the fixing temperature, so that the detected temperature is decreased to the fixing temperature, wherein, in case that an increasing rate of the detected temperature at the beginning of the print control is equal to or less than a predetermined value, the control unit controls the heat source so that a heat quantity radiated from the heat source during the decreasing control becomes larger than that in the case that the increasing rate of the detected temperature at the beginning of the print control is larger than the predetermined value.

According to this disclosure, in case that the increasing of the temperature at the beginning of the print control is slow and the pressing member or the like is cooled (in case that the increasing rate is the predetermined value or less), the heat quantity radiated from the heat source during the decreasing control is to be increased. Therefore, it is possible to give a large heat quantity to the heating member. Therefore, when the print control is performed in a state where the pressing member or the like is cool, even if the heat quantity of the heating member is absorbed by a recording sheet, it is possible to suppress undershoot of the temperature of the heating member.

According to this disclosure, it is possible to suppress undershoot of the temperature of the heating member.

BRIEF DESCRIPTION OF THE DRAWINGS

The foregoing and additional features and characteristics of this disclosure will become more apparent from the following detailed descriptions considered with the reference to the accompanying drawings, wherein:

FIG. 9A is a graph illustrating changes in the temperature of a heating member and the like, and FIG. 9B is a time chart illustrating the control state of a heat source.

DETAILED DESCRIPTION

Hereinafter, an illustrative embodiment of this disclosure will be described in detail with reference to drawings, appropriately. In the following description, a schematic configuration of a laser printer 1 will be briefly described as an example of an image forming apparatus according to an illustrative embodiment of this disclosure, and then the detailed configuration of this disclosure will be described later.

<Schematic Configuration of Laser Printer>

Figure 1:
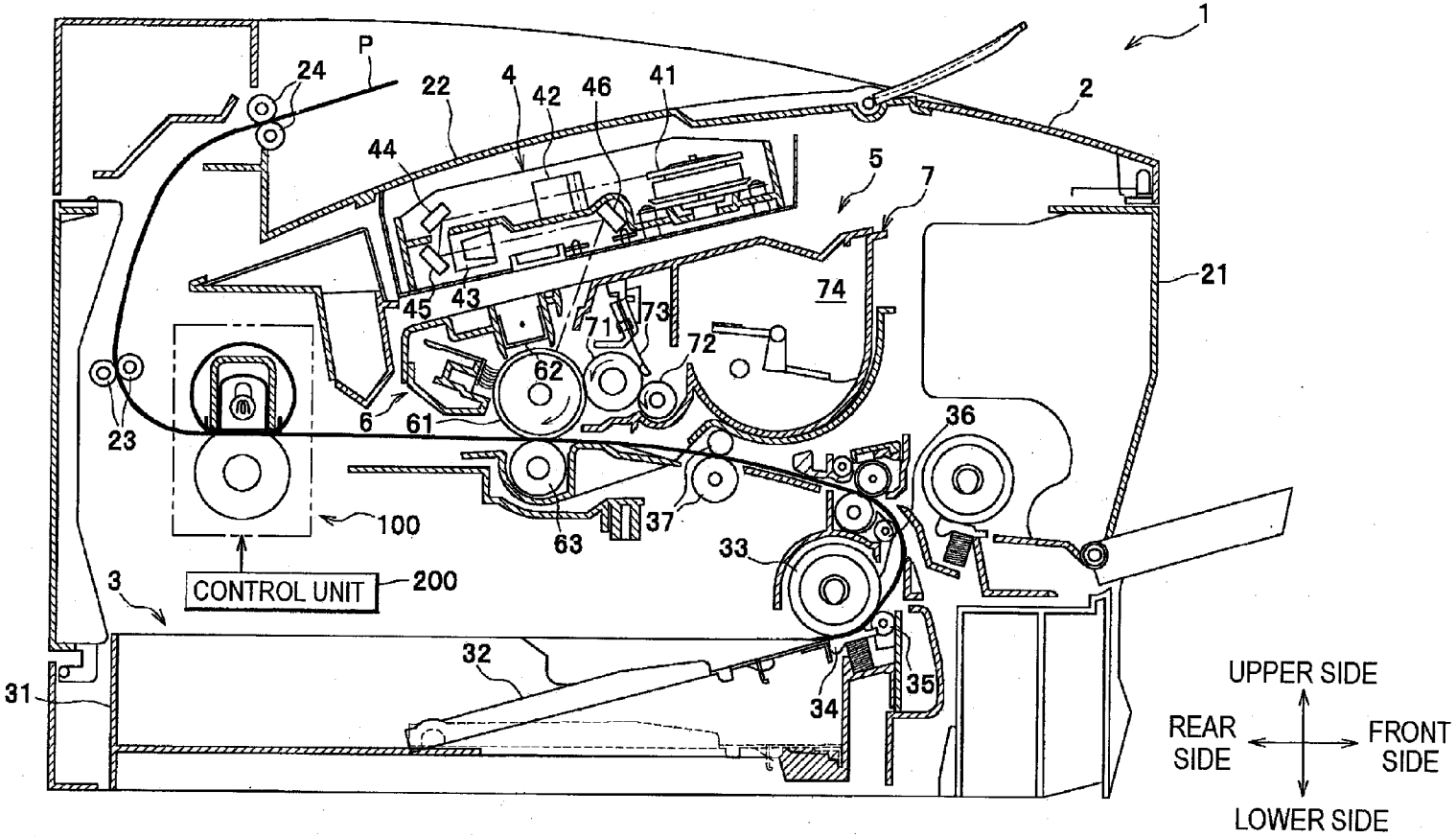
FIG. 1 is a view schematically illustrating a configuration of a laser printer according to an illustrative embodiment of this disclosure.

As shown in FIG. 1, the laser printer 1 includes in a body housing 2, a sheet feeding unit 3 that feeds a sheet P as an example of a recording sheet, an exposing unit 4, a process cartridge 5 that transfers a toner image (developer image) onto the sheet P, and a fuser unit 100 that heat-fixes the toner image onto the sheet P by heat.

In the following description, directions will be described on the basis of a user who uses the laser printer. That is, the right side of FIG. 1 is referred to as the 'front', the left side is referred to as the 'rear', the front side is referred to as the 'left side' and the back side is referred to as the 'right side.' Also, the upper-lower direction of FIG. 1 is referred to as the 'upper-lower.'

The sheet feeding unit 3 is provided at the lower part of the body housing 2, and includes a sheet feeding tray 31 for accommodating sheets P, a sheet pressing plate 32 for holding up the front side of each sheet P, a sheet feeding roller 33, a sheet feeding pad 34, paper-dust removing rollers 35 and 36, and registration rollers 37. The sheets P in the sheet feeding tray 31 are brought near to the sheet feeding roller 33 by the sheet pressing plate 32, and are separated one by one by the sheet feeding roller 33 and the sheet feeding pad 34, and are conveyed toward the process cartridge 5 through the paper-dust removing rollers 35 and 36 and the registration rollers 37.

The exposing unit 4 is disposed at the upper part in the body housing 2, and includes a laser emission unit (not shown), a polygon mirror 41 which is driven to rotate, lenses 42 and 43, and reflective mirrors 44, 45, and 46. In the exposing unit 4, a laser light (refer to the dotted-dashed line) based on image data is emitted from the laser emission unit, is reflected by or passes through the polygon mirror 41, the lens 42, the reflecting mirrors 44 and 45, the lens 43, and the reflecting mirror 46, in their order, and is irradiated onto a surface of a photosensitive drum 61 to scan the surface of the photosensitive drum 61 at high speed.

The process cartridge 5 is disposed below the exposing unit 4, and is configured to be detachably mounted to the body housing 2 from an opening when a front cover 21 of the body housing 2 is opened. The process cartridge 5 includes a drum unit 6 and a developing unit 7.

The drum unit 6 includes the photosensitive drum 61, a charger 62, and a transfer roller 63. Also, the developing unit 7 is configured to be detachably mounted to the drum unit 6, and includes a developing roller 71, a supply roller 72, a layer-thickness regulating blade 73, and a toner container 74 for containing toner (developer).

In the process cartridge 5, the surface of the photosensitive drum 61 is uniformly charged by the charger 62, and then is exposed by high-speed scanning with the laser light from the exposing unit 4, so that an electrostatic latent image based on the image data is formed on the photosensitive drum 61. Further, the toners in the toner container 74 is supplied to the developing roller 71 through the supply roller 72, are introduced to a gap between the developing roller 71 and the layer-thickness regulating blade 73, and are carried on the developing roller 71 as a thin layer having a constant thickness.

The toner held on the developing roller 71 is supplied from the developing roller 71 to the electrostatic latent image formed on the photosensitive drum 61. Therefore, the electrostatic latent image is visualized, that is, a toner image is formed on the photosensitive drum 61. Then, a sheet P is carried between the photosensitive drum 61 and the transfer roller 63, so that the toner image on the photosensitive drum 61 is transferred onto the sheet P.

The fuser unit 100 is provided on the rear side relative to the process cartridge 5. The transferred toner image (toner) onto the sheet P passes through the fuser unit 100, so that the toner image is heat-fixed on the sheet P by heat. The sheet P having the toner image fixed thereon by heat is discharged onto a sheet discharge tray 22 by conveyance rollers 23 and 24.

<Detailed Configuration of Fuser Unit>

Figure 2:
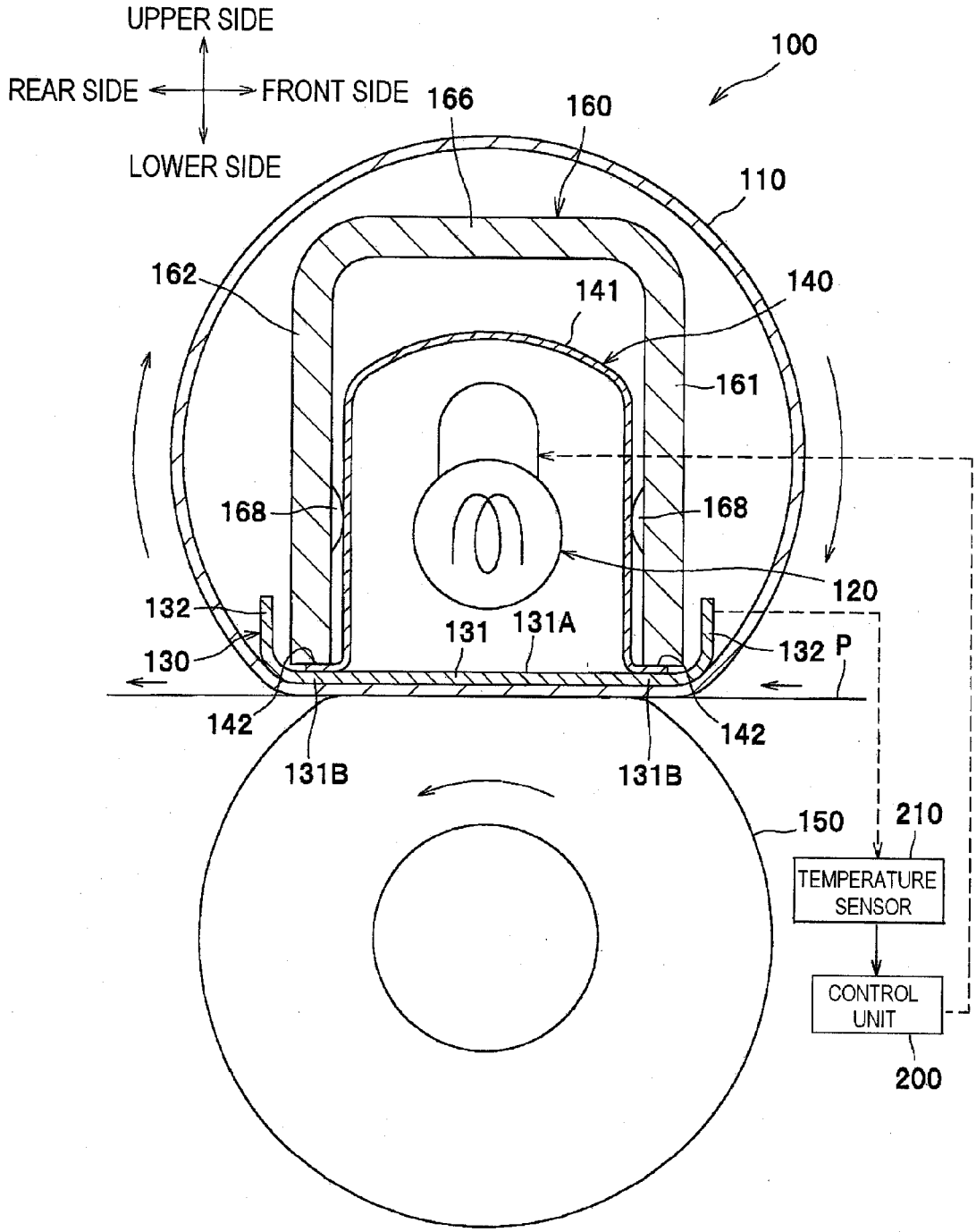
FIG. 2 is a view schematically illustrating a configuration of a fuser unit.

As shown in FIG. 2, the fuser unit 100 includes a fixing film 110, a halogen lamp 120 which is an example of the heat source, a nip plate 130 which is an example of a heating member, a reflective plate 140, a pressing roller 150 which is an example of a backup member, and a stay member 160.

The fixing film 110 is an endless (cylindrical) film having heat resistance and flexibility, and the rotation of both end of the fixing film 110 is guided by guide members (not shown). The fixing film 110 is configured to slidingly contact with the nip plate 130 through grease. According to the materials of the fixing film and the nip plate, the grease may not be necessarily applied.

The halogen lamp 120 heats the nip plate 130 and the fixing film 110 so as to heat the toner on the sheet P, and is disposed inside the fixing film 110 with predetermined gaps from the inner surfaces of the fixing film 110 and the nip plate 130.

The nip plate 130 is a plate-shaped member, which receives radiant heat radiated from the halogen lamp 120, and is heated to a predetermined fixing temperature (a temperature for fixing the toner image on the sheet P by heat) by the halogen lamp 120. In the present illustrative embodiment, the temperature of the nip plate 130 is detected by a temperature sensor 210 which is an example of a temperature detector, and the detected temperature is output to a control unit 200.

The nip plate 130 is disposed to slidably contact with the inner surface of the cylindrical fixing film 110, and transfers the radiant heat received from the halogen lamp 120 to the toner on the sheet P through the fixing film 110.

The nip plate 130 is formed by bending, for example, an aluminum plate having heat conductivity higher than that of the stay member 160 made of steel (to be described below), into a substantial U shape in a cross-sectional view. More specifically, the nip plate 130 includes a base part 131 to extend along a front-rear direction (the conveyance direction of the sheet P) in a cross-sectional view, and a bent part 132 bent upward (from the pressing roller 150 toward the nip plate 130).

Figure 3:
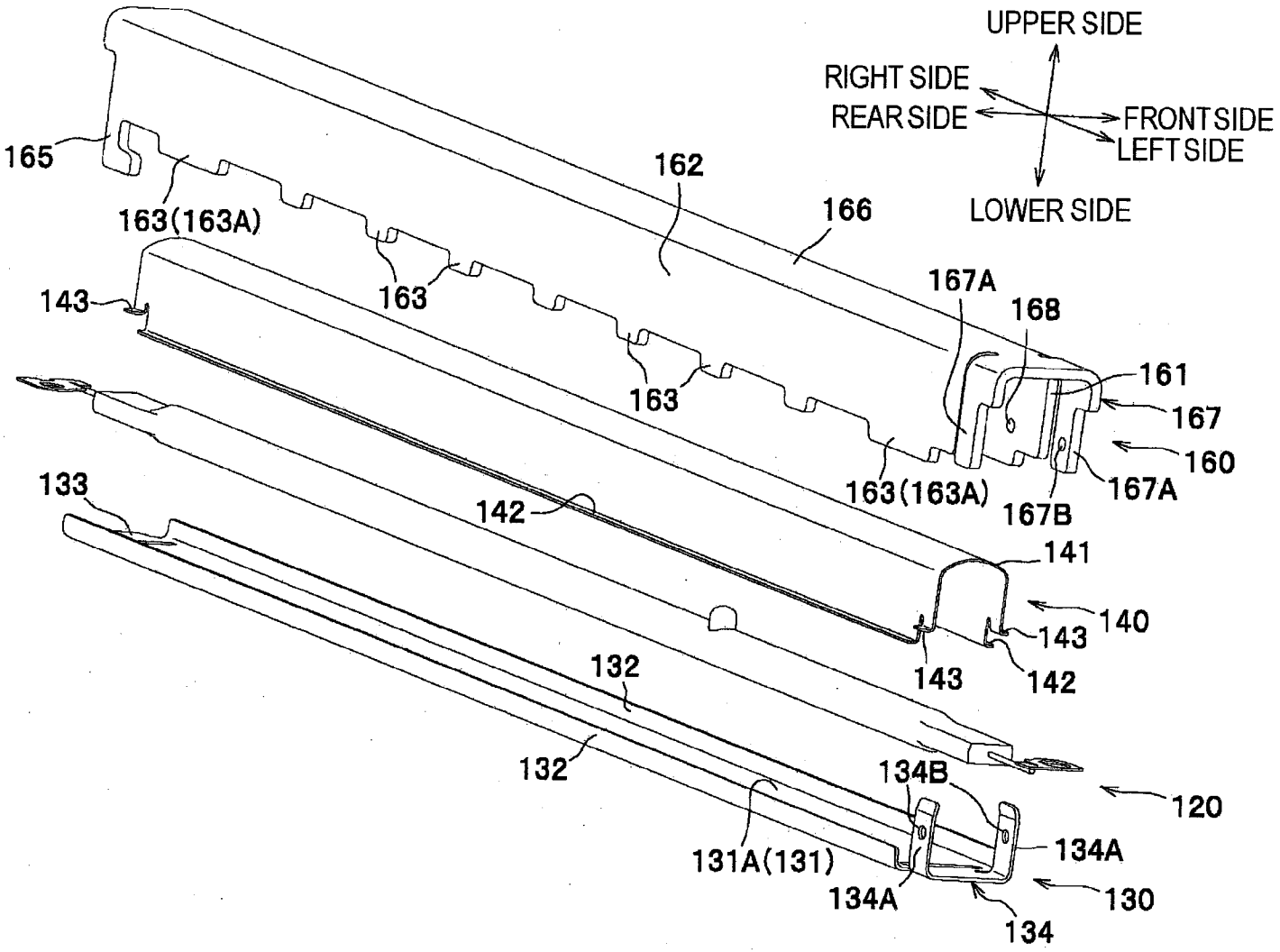
FIG. 3 is a perspective view illustrating a halogen lamp, a nip plate, a reflective plate, and a stay member.

As shown in FIG. 3, the nip plate 130 further includes an insertion part 133 extending in a plate shape from the right end of the base part 131, and an engagement part 134 formed at the left end of the base part 131. The engagement part 134 is formed in a U shape in a side view, and includes side wall part 134A formed to be bent upward and having engagement holes 134B.

As shown in FIG. 2, the reflective plate 140 is a member which reflects the radiant heat from the halogen lamp 120 (mainly radiant heat radiated in the front-rear direction and upward) toward the nip plate 130 (an inner surface 131A of the base part 131), and is disposed inside the fixing film 110 so as to surround the halogen lamp 120 with a predetermined gap from the halogen lamp 120.

The radiant heat from the halogen lamp 120 is converged to on the nip plate 130 by the reflective plate 140. Therefore, it is possible to effectively use the radiant heat from the halogen lamp 120 and thus quickly heat the nip plate 130.

The reflective plate 140 is formed by bending, for example, an aluminum plate having high reflectivity for infrared and far-infrared rays, into a substantial U shape in a cross-sectional view. More specifically, the reflective plate 140 includes a reflective member 141 having a bent shape (a substantial U shape in cross-sectional view), and a flange part 142 extending outward from both end of the reflective member 141 in the front-rear direction. In order to increase heat reflectivity, the reflective plate 140 may be formed with, for example, a mirrored aluminum plate.

Figure 4:
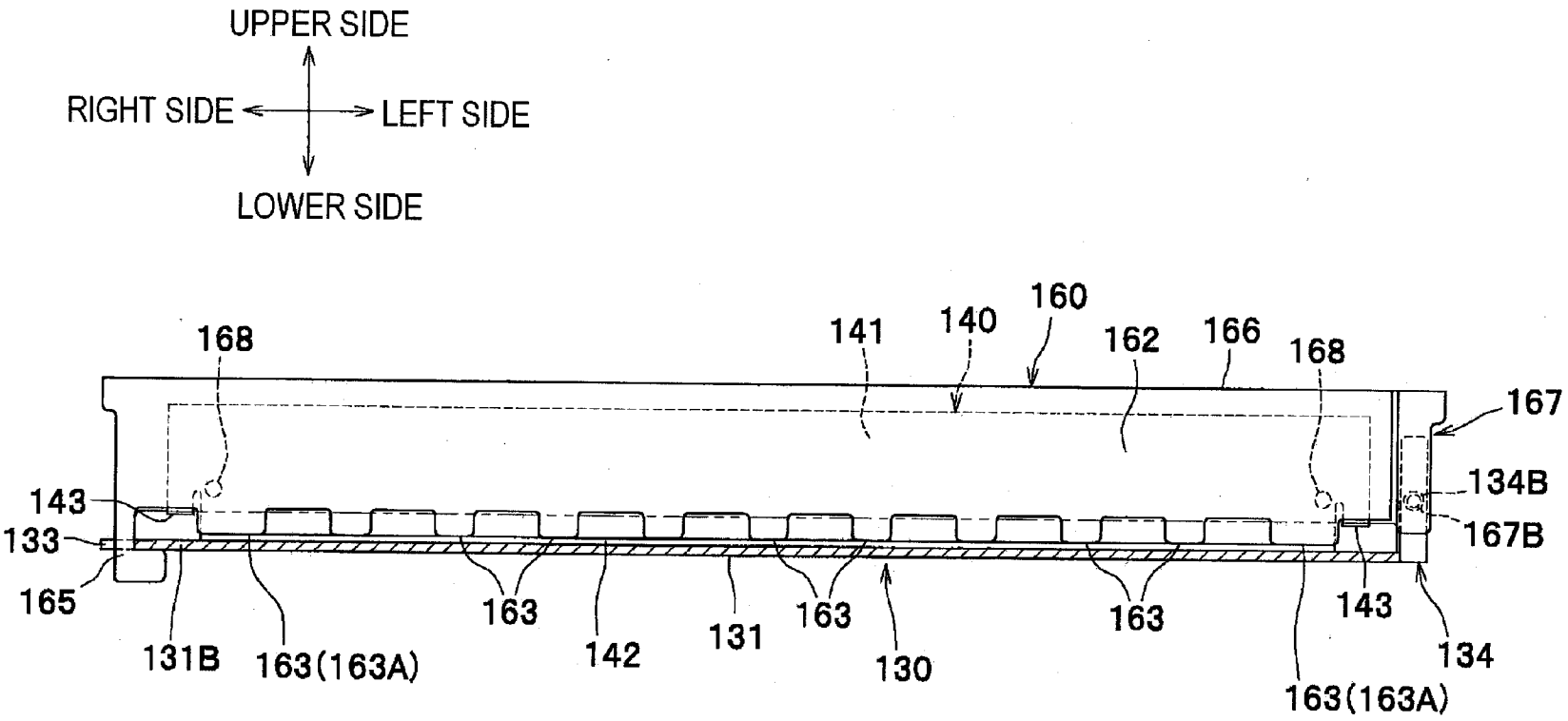
FIG. 4 is a view illustrating the nip plate, the reflective plate, and the stay member as seen from a conveyance direction.

As shown in FIG. 3, at the both end of the reflective plate 140 in the left-right direction (the width direction of the sheet P), four flange-shaped locking parts 143 are formed in total (although only three locking parts 143 are shown in FIG. 3). The locking parts 143 are positioned above the flange parts 142, and are disposed to sandwich a plurality of contact parts 163 of the stay member 160 (to be described below) (to be adjacent to the outermost contact parts 163A in the left-right direction) when the nip plate 130, the reflective plate 140, and the stay member 160 are assembled as shown in FIG. 4.

Therefore, even if the reflective plate 140 tries to move in the left-right direction due to vibration or the like when the fuser unit 100 is in a driven state, since the locking parts 143 abut the contact parts 163A, the position of the reflective plate 140 in the left-right direction is regulated. As a result, it is possible to suppress misalignment of the reflective plate 140 in the left-right direction.

As shown in FIG. 2, the pressing roller 150 is an elastically deformable member, and is disposed below the nip plate 130. Further, the pressing roller 150 is elastically deformed, and in this state, the fixing film 110 is sandwiched between the pressing roller 150 and the nip plate 130, so that a nip part is configured between the pressing roller 150 and the fixing film 110.

Furthermore, the pressing roller 150 is configured to rotate by a driving force transmitted from a motor (not shown) provided in the body housing 2. Therefore, the pressing roller 150 and the nip plate 130 nip the fixing film 110 and the sheet P, and send them toward the rear side. As a result, while the fixing film 110 is rotated according to the rotation of the pressing roller 150, the sheet P is conveyed toward the rear side.

Moreover, since the sheet P is conveyed between the pressing roller 150 and the heated nip plate 130 (more specifically, the fixing film 110) as descried above, the transferred toner image on the sheet P is fixed by heat.

The stay member 160 is a member which supports both end 131B of the nip plate 130 (the base part 131) in the front-rear direction, through the flange parts 142 of the reflective plate 140, thereby securing the rigidity of the nip plate 130. The stay member 160 has a shape (a substantial U shape in a cross-sectional view) according to a shape of an outer surface of the reflective plate 140 (reflective member 141), and is disposed to cover the reflective plate 140. This stay member 160 is formed by bending, for example, a steel plate having relatively high rigidity, in a substantial U shape in a cross-sectional view.

At the lower ends of a front wall 161 and a rear wall 162 of the stay member 160, as shown in FIG. 3, the plurality of contact part 163 is provided to have a pectinate shape.

Further, at the right end of the front wall 161 and the rear wall 162 of the stay member 160, substantial L-shaped locking parts 165 are provided to extend downward and then bend toward the left side. Furthermore, at the left end of the stay member 160, a holding part 167 is provided to extend from a top wall 166 toward the left side, and to be bent in a substantial U shape in a side view. At the each of inner surfaces of side wall parts 167A of the holding part 167, engagement bosses 167B are provided to protrude inward (although only one engagement boss is shown in FIG. 3).

As shown in FIGS. 2 and 3, at the left and right end of the inner surfaces of the front wall 161 and the rear wall 162 of the stay member 160, total four abutting bosses 168 are provided to protrude inward. The abutting bosses 168 abut the reflective plate 140 (reflective member 141) in the front-rear direction. Therefore, even if the reflective plate 140 tries to move in the front-rear direction due to vibration or the like when the fuser unit 100 is in the driven state, since the reflective plate 140 abuts the abutting bosses 168, the position of the reflective plate 140 in the front-rear direction is regulated. As a result, it is possible to suppress misalignment of the reflective plate 140 in the front-rear direction.

When the reflective plate 140 and the nip plate 130 are assembled, the reflective plate 140 is first fit into the stay member 160 described above and then the stay member 160 is installed. Since the abutting bosses 168 are provided at the inner surfaces of the front wall 161 and the rear wall 162 of the stay member 160, the abutting bosses 168 abuts the reflective plate 140, so that the reflective plate 140 is temporarily held in the stay member 160.

Next, as shown in FIG. 4, the insertion part 133 of the nip plate 130 is inserted between the locking parts 165 of the stay member 160, so that the base part 131 (both end 131B) is engaged with the locking parts 165. Then, the engagement part 134 (engagement holes 134B) of the nip plate 130 is engaged with the holding part 167 (engagement bosses 167B) of the stay member 160.

Therefore, the both end 131B of the base part 131 are supported by the locking parts 165, and the engagement part 134 is held by the holding part 167, so that the nip plate 130 is held in the stay member 160. Then, while the flange parts 142 are sandwiched between the nip plate 130 and the stay member 160, the reflective plate 140 is held in the stay member 160.

Therefore, even if the reflective plate 140 tries to move a vertical direction due to vibration or the like when the fuser unit 100 is in the driven state, since the flange parts 142 are sandwiched between the nip plate 130 and the stay member 160, the position of the reflective plate 140 in the vertical direction is regulated. As a result, it is possible to suppress misalignment of the reflective plate 140 in the vertical direction, and to fix the position of the reflective plate 140 relative to the nip plate 130.

<Control Unit>

As shown in FIG. 2, the control unit 200 includes, for example, a CPU, a RAM, a ROM, and an input/output circuit, and performs control by performing various kinds of arithmetic processing based on an input from the temperature sensor 210, a print command, programs and data stored in the ROM, and so on.

Specifically, in a case that the control unit 200 receives a print command while the temperature of the nip plate 130 is increasing to the fixing temperature, if the detected temperature detected by the temperature sensor 210 reaches the fixing temperature, the control unit 200 starts print control, and if the detected temperature reaches a predetermined temperature is equal to or higher than the fixing temperature, the control unit 200 performs decreasing control so that the detected temperature decreases to the fixing temperature. Further, in the case that a an increasing rate of the detected temperature in the beginning of the print control is a predetermined value or less, the control unit controls the halogen lamp 120 so that the heat quantity radiated from the halogen lamp 120 during the decreasing control is larger than that in the case that the increasing rate of the detected temperature in the beginning of the print control is larger than the predetermined value.

Figure 6:
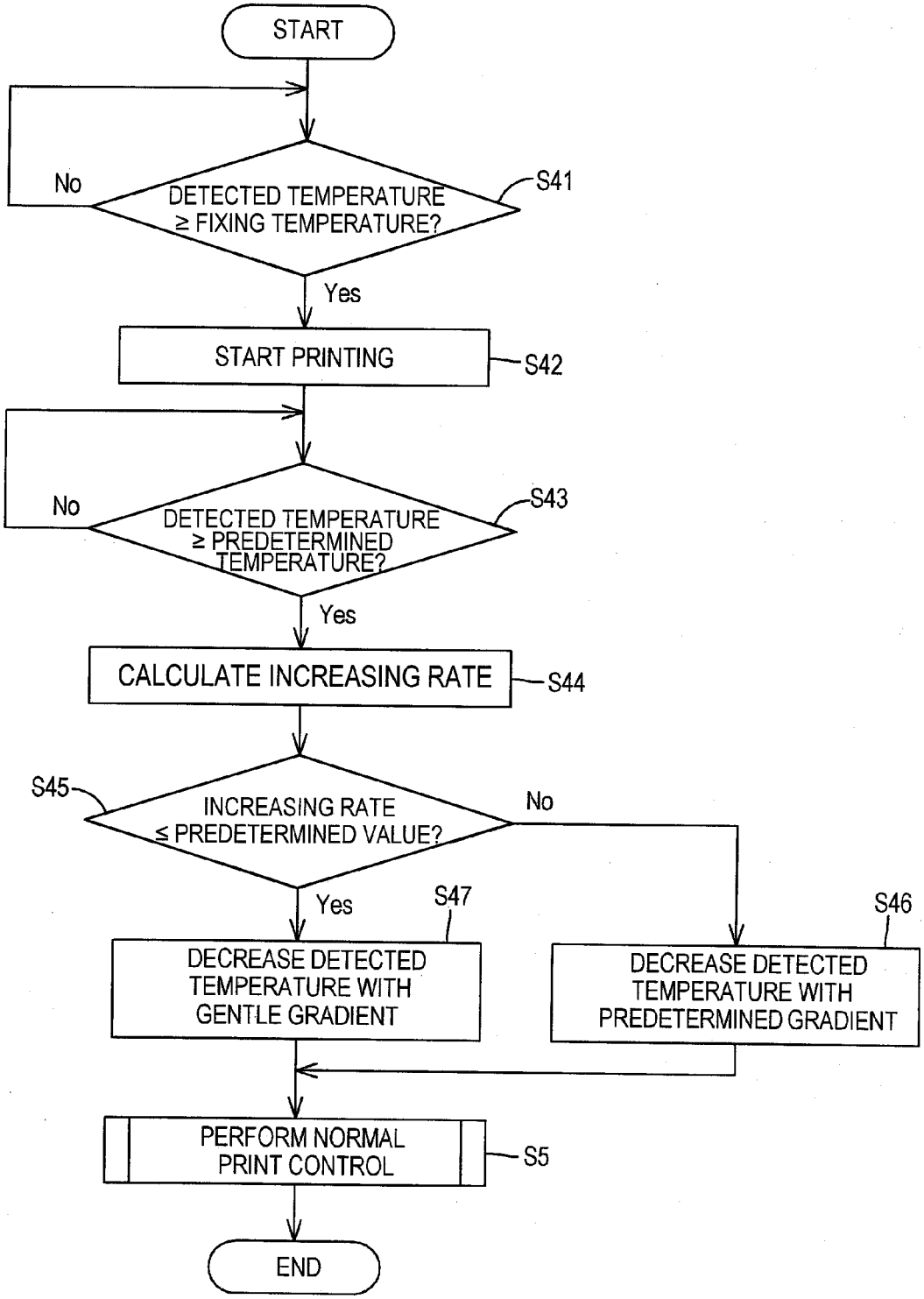
FIG. 6 is a flow chart illustrating high-temperature print control.
Figure 7A:
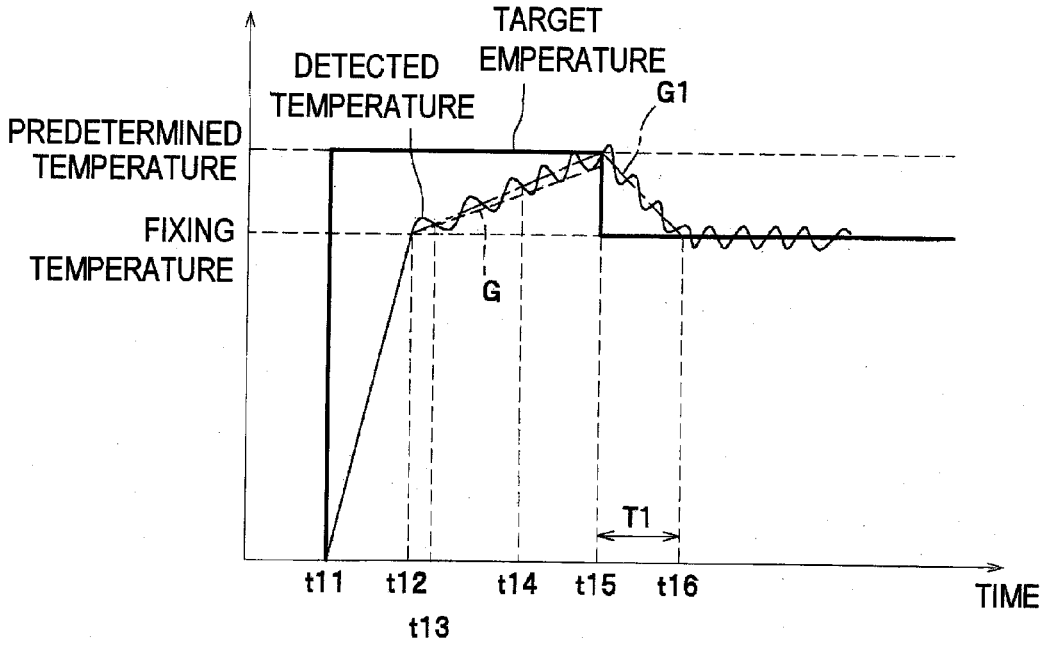
FIG. 7A is a graph illustrating changes in detection temperature and the like when the rate of increase in the detection temperature is larger than a predetermined value.

Here, the beginning of the print control corresponds to a time period from a time point when the print control starts to a time point when the detected temperature reaches the predetermined temperature (for example, from a time point t12 to a time point t15 shown in FIG. 7A). More specifically, the control unit 200 performs control based on flow charts as shown in FIGS. 5 and 6.

Figure 5:
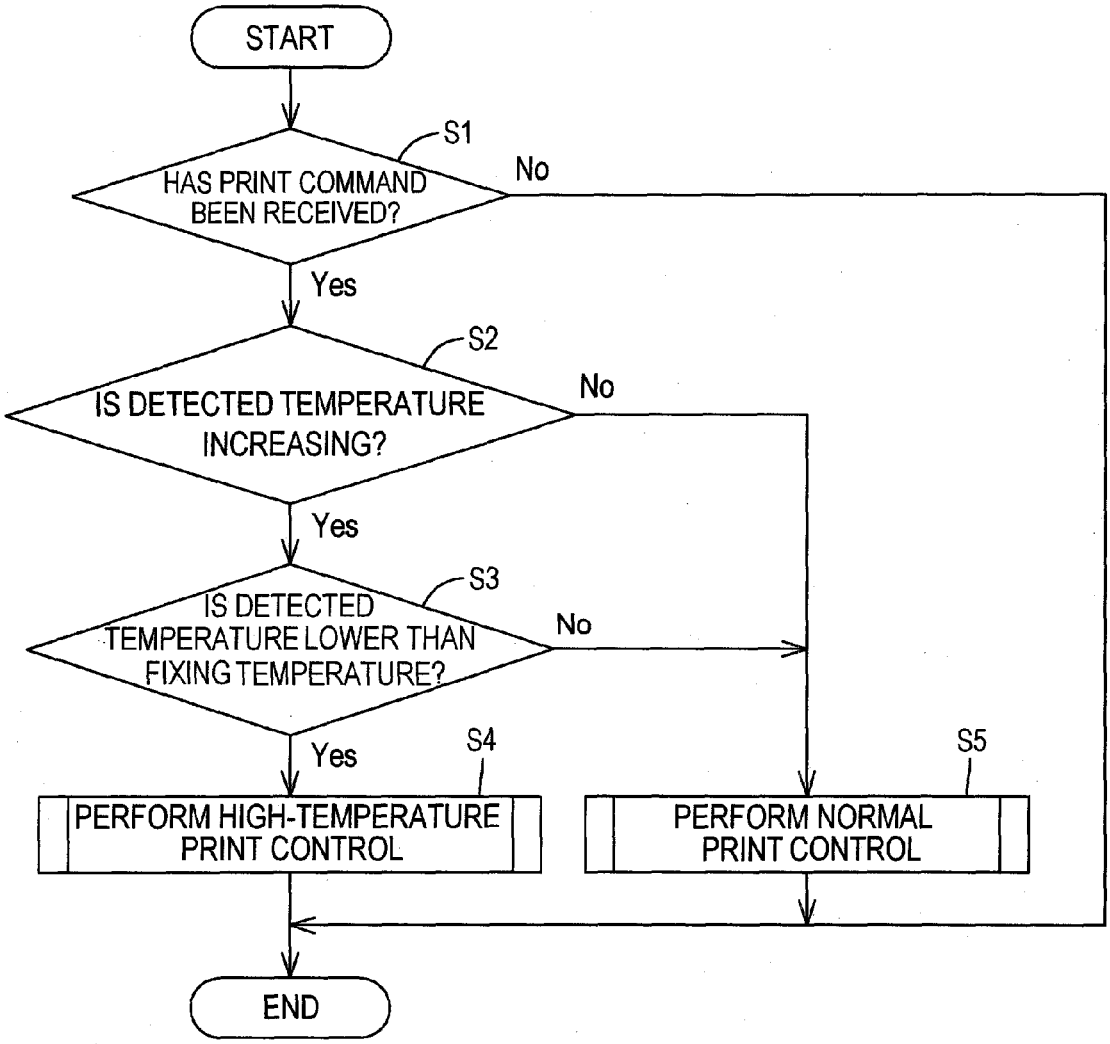
FIG. 5 is a flow chart illustrating an operation of a control unit.

As shown in FIG. 5, in step S1, the control unit 200 determines whether any print control has been received. When it is determined in step S1 that any print command has not been received (NO), the control unit 200 finishes the present control, and when it is determined in step S1 that a print command has been received (YES), in step S2, the control unit 200 determines whether the detected temperature is increasing.

Specifically, in step S2, the control unit 200 determines whether the detected temperature is increasing, based on a current value and a previous value of the detected temperature. In case that it is determined in step S2 that the detected temperature is increasing (YES), in step S3, the control unit 200 determines whether the detected temperature is lower than the fixing temperature.

In other words, the control unit 200 performs the processes of step S1 to step S3, so as to determine whether any print command has been received while the detected temperature (the temperature of the nip plate 130) is increasing to the fixing temperature. In case that it is determined in step S3 that the detected temperature is lower than the fixing temperature (YES), in step S4, the control unit 200 performs high-temperature print control different from normal print control.

In case that it is determined in step S2 that the detected temperature is not on a rising trend (NO), or in case that it is determined in step S3 that the detected temperature is equal to or higher than the fixing temperature (NO), in step S5, the control unit 200 performs the normal print control. Here, an example of case that the detected temperature is not being a rising trend or case that the detected temperature is equal to or higher than the fixing temperature includes a case that the control is being performed so that the heat source is switched on or off in a ready mode or a fixing mode to control the detected temperature to become a predetermined target value. The normal print control corresponds to a known control for controlling the heat source such that the heat source is switched on or off to maintain the detected temperature at the fixing temperature.

Next, the high-temperature print control of step S4 will be described. As shown in FIG. 6, if the high-temperature print control starts, at first, in step S41 the control unit 200 determines whether the detected temperature is equal to or higher than the fixing temperature. In case that it is determined in step S41 that the detected temperature is lower than the fixing temperature (NO), the control unit 200 repeats the process of step S41, and in case that it is determined that the detected temperature is equal to or higher than the fixing temperature (YES), in step S42, the control unit 200 starts printing.

Here, print or printing indicates known controls on components (such as the exposing unit 4 and various rollers) except for the halogen lamp 120.

After step S42, in step S43, the control unit 200 determines whether the detected temperature is equal to or higher than the predetermined temperature. In case that it is determined in step S43 that the detected temperature is lower than the predetermined temperature (NO), the control unit 200 repeats the process of step S43, and in case that the detected temperature is equal to or higher than the predetermined temperature (YES), in step S44, the control unit 200 calculates the increasing rate of the detected temperature during the print control until that time.

Here, "the increasing rate of the detected temperature during the print control" indicates an increasing rate calculated from a history of the detected temperature detected while the sheet P has passed through the nip part between the pressing roller 150 and the fixing film 110.

The determination whether the sheet P is passing through the nip part may be performed based on an elapsed time period from when feeding the sheet P starts by the sheet feeding roller 33, or may be performed based on an elapsed time period from when passage of the sheet is sensed by a sheet passage sensor provided upstream of the nip part in the sheet conveyance direction. The increasing rate may corresponds to a value (in a unit of ° C./sec) obtained by dividing an amount of change in temperature by a time period, or may corresponds to an amount of change (difference in a unit of ° C.) in temperature in a predetermined time period.

In this illustrative embodiment, in step S44, the control unit 200 calculates the increasing rate based on the temperature history during printing on a plurality of sheets P. Here, the temperature history during printing on a plurality of sheets P indicates a detected temperature (shown by a thin solid line) changing in a Sine curve shape from the time point t12 to the time point t15 as shown in FIG. 7A, and a sine wave of one cycle corresponds to a detected temperature detected during printing on one sheet P.

Specifically, for example, the control unit 200 obtains a difference temperature between an average temperature (a value at a time point t13) of a section shown by a sine wave corresponding to printing on a first sheet P, and an average temperature (a value at a time point t14) of a section shown by a sine wave corresponding to printing on a third sheet P, and divides the difference temperature by the elapsed time period (obtained by subtracting the time point t13 from the time point t14), thereby calculating the increasing rate. However, the calculation of the increasing rate is not limited thereto. For example, the increasing rate may be calculated by obtaining an approximate straight line based on a plurality of average temperatures corresponding to printing on all of sheets from when the printing starts to when the detected temperature reaches the predetermined temperature.

Figure 7B:
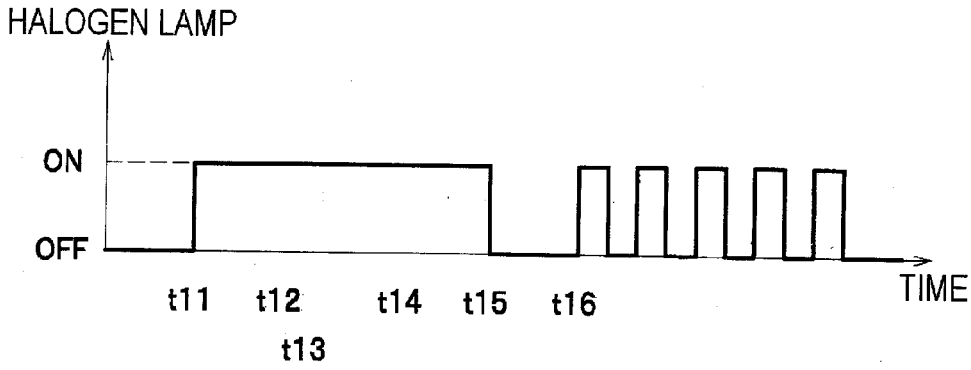
FIG. 7B is a time chart illustrating the control state of the halogen lamp when the rate of increase in the detection temperature is larger than the predetermined value.

After step S44, in step S45, the control unit 200 determines whether the increasing rate is equal to or less than a predetermined value (shown by a reference symbol G in FIG. 7A). In case that it is determined in step S45 that the increasing rate is larger than the predetermined value G (NO), since the temperatures of the sheet P and the pressing roller 150 are not so low, in step S46, the control unit 200 switches off the halogen lamp 120 (at the time point t15) as shown in FIG. 7B, so that the detected temperature decreases to the fixing temperature with a predetermined gradient G1 as shown in FIG. 7A. In other words, in case that the increasing rate of the detected temperature at the beginning of the print control (from the time point t12 to the time point t15) is larger than the predetermined value G, the control unit 200 switches off the halogen lamp 120 so that the detected temperature decreases for a first predetermined time period T1 during the decreasing control.

Figure 8A:
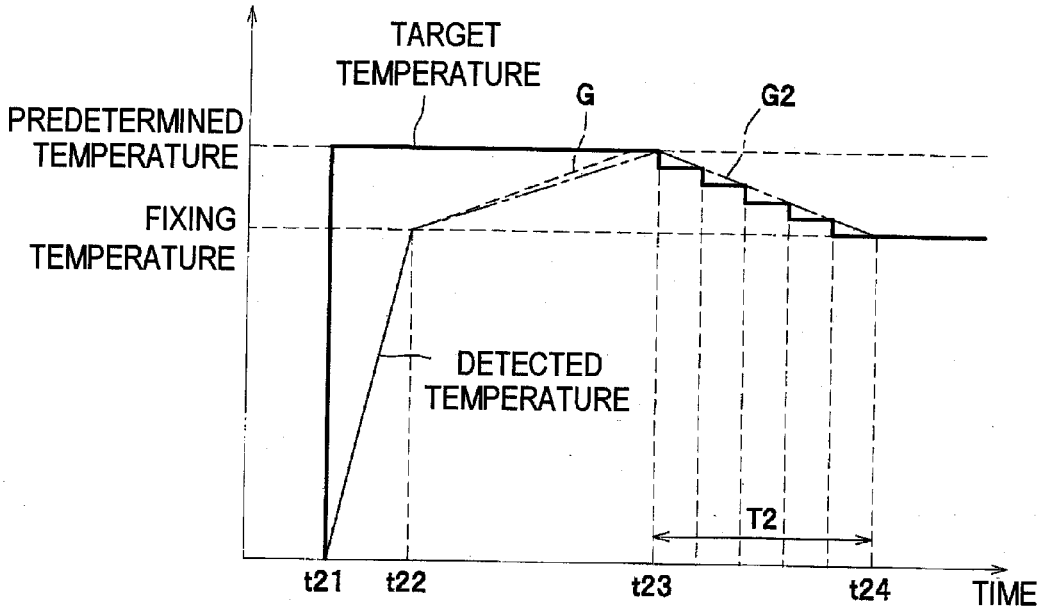
FIG. 8A is a graph illustrating changes in the detection temperature and the like when the rate of increase in the detection temperature is the predetermined value or less.
Figure 8B:
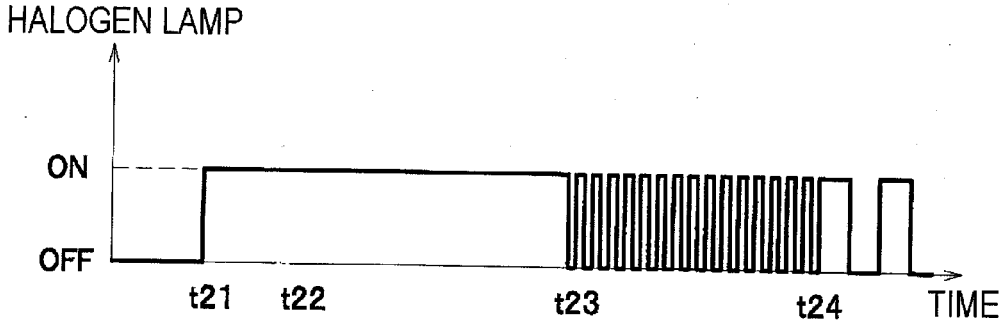
FIG. 8B is a time chart illustrating the control state of the halogen lamp when the rate of increase in the detection temperature is the predetermined value or less.
Figure 9A:
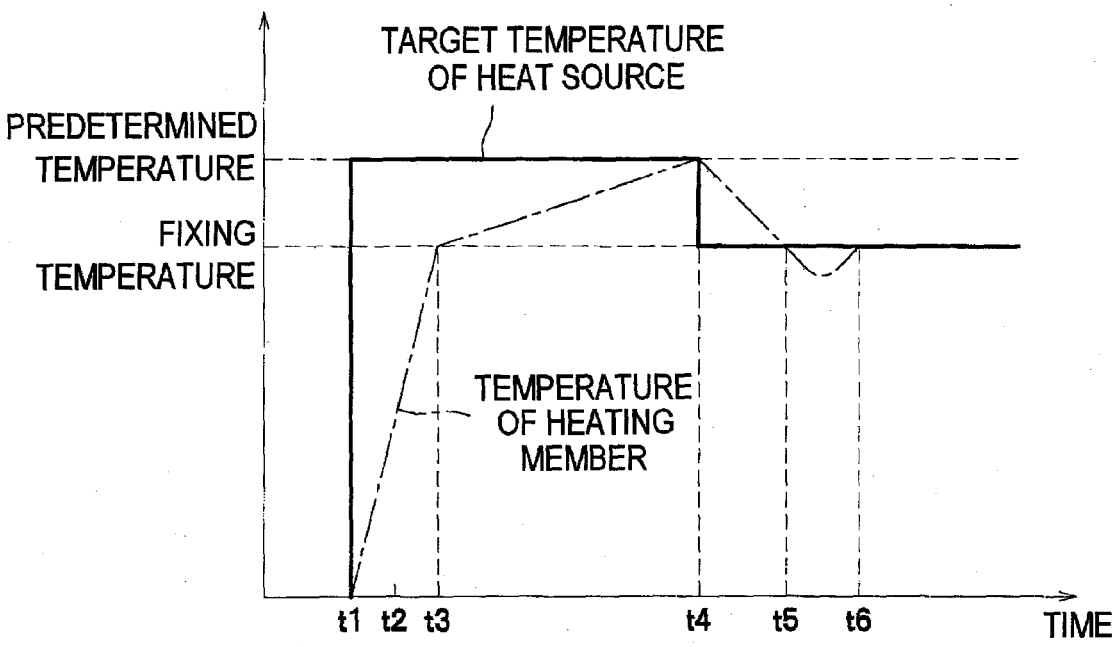
FIGS. 9A and 9B are views illustrating a comparative example to this disclosure, and more specifically.
Figure 9B:
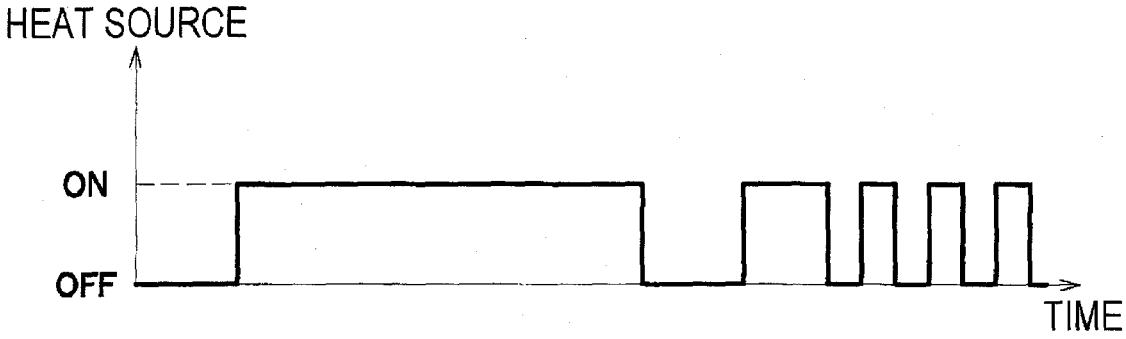

In case that it is determined in step S45 that the increasing rate is less than the predetermined value G (YES), since the temperatures of the sheet P and the pressing roller 150 are low, in step S47, the control unit 200 performs control adequately than the normal print control (from a time point t23) so that the halogen lamp 120 is switched on or off as shown in FIG. 8B, to decrease the detected temperature to the fixing temperature with a gradient G2 gradually than the predetermined gradient G1, as shown in FIG. 8A. In other words, in case that the increasing rate of the detected temperature at the beginning of the print control (from a time point t22 to the time point t23) is equal to or less than the predetermined value G, the control unit 200 performs control adequately than the normal print control so that the halogen lamp 120 is switched on or off, so as to decrease the detected temperature over a second predetermined time period T2 longer than the first predetermined time period T1 during the decreasing control.

In FIG. 8A, with considering visibility of the drawing, the detected temperature after the printing starts (the time point t22) is not shown in a sine wave shape and is shown by straight lines representing average values.

More specifically, the control unit 200 performs control on the halogen lamp 120 to decrease in a stepwise manner the target temperature of the nip plate 130 for the second predetermined time period T2. Therefore, in the case that the increasing rate of the detected temperature at the beginning of the print control is equal to or less than the predetermined value G (the case of FIGS. 8A and 8B), it is possible to increase the heat quantity to be radiated from the halogen lamp 120 during the decreasing control, as compared to the case that the increasing rate of the detected temperature at the beginning of the print control is larger than the predetermined value (the case of FIGS. 7A and 7B).

After the detected temperature decreases to the fixing temperature in step S46 or step S47, the control unit 200 performs the normal print control of step S5 so as to perform the remaining printing.

According to the above-mentioned configuration, in the present illustrative embodiment, it is possible to achieve the following effects. In case that an increase in temperature at the beginning of print control is slow since the pressing roller 150 or the like has been cooled (in case that the increasing rate is the predetermined value G or less), the heat quantity radiated from the halogen lamp 120 during the decreasing control is to be increased. Therefore, it is possible to give a large heat quantity to the nip plate 130. Therefore, when the print control is performed in a state in which the pressing roller 150 or the like is cool, even if the heat quantity of the nip plate 130 is absorbed by the sheet P, it is possible to suppress undershoot of the temperature of the nip plate 130.

Further, in case that an increase in temperature at the beginning of print control is rapid since the pressing roller 150 or the like is sufficiently warmed (in case that the increasing rate is larger than the predetermined value G), the heat quantity radiated from the halogen lamp 120 is to be decreased. Therefore, it is possible to save energy, as compared to that the gradient for the decreasing control is always set to the gentle gradient G2.

Furthermore, since the increasing rate is calculated based on a temperature history during printing on a plurality of sheet P, it is possible to calculate the increasing rate more accurately, as compared to a case where the increasing rate is calculated based on a temperature history corresponding to one sheet.

This disclosure is not limited to this illustrative embodiment, but may be used in various forms as exemplified as follow. In this illustrative embodiment, according to the increasing rate of the detected temperature at the beginning of the print control, different time periods T1 and T2 are set for the decreasing control. However, this disclosure is not limited thereto. If the heat quantity radiated from the heat source is deferent depending on the increasing rate of the detected temperature at the beginning of the print control, the same time period is set for the decreasing controls.

In this illustrative embodiment, the halogen lamp 120 has been exemplified as the heat source. However, this disclosure is not limited thereto. The heat source may be an induction heating (IH) heater, a heat element, or others.

In this illustrative embodiment, the nip plate 130 has been exemplified as the heating member. However, this disclosure is not limited thereto. The heating member may be a cylindrical heating roller. In this illustrative embodiment, the sheets P such as a thick paper, a postcard, and a thin sheet have been exemplified as the recording sheet. However, this disclosure is not limited thereto. The recording sheet may be an OHP sheet.

In this illustrative embodiment, the pressing roller 150 has been exemplified as the backup member. However, this disclosure is not limited thereto. The backup member may be a belt-shaped pressing member. A nip pressure between the backup member and the heating member may be generated by pressing the backup member against the heating member, or by pressing the heating member against the backup member.

In this illustrative embodiment, the temperature sensor 210 for directly detecting the temperature of the nip plate 130 (heating member) has been exemplified as the temperature detector. However, this disclosure is not limited thereto. The temperature detector may be a temperature sensor for detecting the temperature of the heating member indirectly (for example, indirectly through the backup member).

In this illustrative embodiment, this disclosure has been applied to the laser printer 1. However, this disclosure is not limited thereto. This disclosure may be applied to other image forming apparatuses such as a copy machine and a multifunction apparatus.

What is claimed is:

1. An image forming apparatus comprising:

a fuser unit, which includes a heating member, a heat source configured to heat the heating member, and a backup member configured to nip a recording sheet between itself and the heating member;

a temperature detector, which is configured to detect a temperature of the heating member; and a control unit, which is configured to start print control when the temperature detected by the temperature detector reaches a fixing temperature when a print command is received while the temperature of the heating member is increasing to the fixing temperature, and which is configured to perform decreasing control when the detected temperature reaches a predetermined temperature higher than the fixing temperature, so that the detected temperature is decreased to the fixing temperature, wherein, in a case that an increasing rate of the detected temperature at a beginning of the print control is equal to or less than a predetermined value, the control unit is configured to control the heat source so that a heat quantity radiated from the heat source during the decreasing control becomes larger than in a case that the increasing rate of the detected temperature at the beginning of the print control is larger than the predetermined value, and wherein the control unit is configured to calculate the increasing rate based on a temperature history during printing on a plurality of recording sheets, wherein, in the case that the increasing rate of the detected temperature at the beginning of the print control is larger than the predetermined value, the control unit is configured to control the heat source so that the detected temperature is decreased during a first predetermined time period during the decreasing control, and wherein, in the case that the increasing rate of the detected temperature at the beginning of the print control is equal to or less than the predetermined value, the control unit is configured to control the heat source so that the detected temperature is decreased during a second predetermined time period longer than the first predetermined time period, during the decreasing control.

2. The image forming apparatus according to claim 1, wherein the control unit is configured to decrease in a stepwise manner a target temperature for the heating member during the second predetermined time period.

3. An image forming apparatus comprising:

a fuser unit, which includes a heating member, a heat source configured to heat the heating member, and a backup member configured to nip a recording sheet between itself and the heating member;

a temperature detector, which is configured to detect a temperature of the heating member; and a control unit, which is configured to start print control when a temperature detected by the temperature detector reaches a first temperature, and which is configured to perform decreasing control when the detected temperature reaches a second temperature higher than the first temperature, so that the detected temperature is decreased to a temperature lower than the second temperature, wherein, in a case that an increasing rate of the detected temperature at a beginning of the print control is equal to or less than a predetermined value, the control unit is configured to control the heat source so that a heat quantity radiated from the heat source during the decreasing control becomes larger than in a case that the increasing rate of the detected temperature at the beginning of the print control is larger than the predetermined value, and wherein, in the case that the increasing rate of the detected temperature at the beginning of the print control is larger than the predetermined value, the control unit is configured to control the heat source so that the detected temperature is decreased during a first predetermined time period during the decreasing control, and wherein, in the case that the increasing rate of the detected temperature at the beginning of the print control is equal to or less than the predetermined value, the control unit is configured to control the heat source so that the detected temperature is decreased during a second predetermined time period longer than the first predetermined time period, during the decreasing control.

4. The image forming apparatus according to claim 3, wherein the control unit is configured to decrease in a stepwise manner a target temperature for the heating member during the second predetermined time period.

5. The image forming apparatus according to claim 3, wherein the fuser unit further includes a fixing film, wherein the heating member and the backup member are configured to nip the fixing film therebetween to form a nip between the fixing film and the backup member, and wherein a recording sheet is to be conveyed at the nip.

6. The image forming apparatus according to claim 5, wherein the heating member includes a nip plate.

7. The image forming apparatus according to claim 6, wherein the temperature detector is configured to detect a temperature of a portion of the nip plate.

8. The image forming apparatus according to claim 7, wherein the nip plate contacts the fixing film through grease.

9. The image forming apparatus according to claim 5, wherein the heat source includes at least one of a halogen lamp and an induction heating heater.

10. An image forming apparatus comprising:

a fuser unit, which includes a heating member, a heat source, and a backup member configured to nip a recording sheet between itself and the heating member;

a temperature detector, which is configured to detect a temperature of the heating member; and a control unit, which is configured to start print control when the temperature detected by the temperature detector reaches a first temperature, and which is configured to perform decreasing control when the detected temperature reaches a second temperature higher than the first temperature, so that the detected temperature is decreased to a temperature lower than the second temperature, wherein, in a case that an increasing rate of the detected temperature at a beginning of the print control is equal to or less than a predetermined value, the control unit is configured to control the heat source so that a heat quantity radiated from the heat source during the decreasing control becomes larger than that in a case that the increasing rate of the detected temperature at the beginning of the print control is larger than the predetermined value, and wherein the control unit is configured to calculate the increasing rate based on a temperature history during printing on a plurality of recording sheets, wherein, in the case that the increasing rate of the detected temperature at the beginning of the print control is larger than the predetermined value, the control unit is configured to control the heat source so that the detected temperature is decreased during a first predetermined time period during the decreasing control, and wherein, in the case that the increasing rate of the detected temperature at the beginning of the print control is equal to or less than the predetermined value, the control unit is configured to control the heat source so that the detected temperature is decreased during a second predetermined time period longer than the first predetermined time period, during the decreasing control.

11. The image forming apparatus according to claim 10, wherein the control unit is configured to decrease in a stepwise manner a target temperature for the heating member during the second predetermined time period.

12. The image forming apparatus according to claim 10, wherein the fuser unit further includes a fixing film, wherein the heating member and the backup member is configured to nip the fixing film therebetween to form a nip between the fixing film and the backup member, and wherein recording sheet is to be conveyed at the nip.

13. The image forming apparatus according to claim 12, wherein the heating member includes a nip plate.

14. The image forming apparatus according to claim 13, wherein the temperature detector is configured to detect a temperature of a portion of the nip plate.

15. The image forming apparatus according to claim 14, wherein the heat source includes at least one of a halogen lamp and an induction heating heater.

16. The image forming apparatus according to claim 14, wherein the nip plate contacts the fixing film through grease.

17. The image forming apparatus according to claim 13, wherein the temperature detector is configured to directly detect a temperature of a portion of the nip plate.

18. The image forming apparatus according to claim 12, wherein the backup member includes a roller that is elastically deformable.

* * * * *